US007921705B2

(12) United States Patent
Hamama et al.

(10) Patent No.: US 7,921,705 B2
(45) Date of Patent: Apr. 12, 2011

(54) ENGINE COOLANT TEMPERATURE ESTIMATION SYSTEM

(75) Inventors: Wajdi B. Hamama, Whitmore Lake, MI (US); Jon C. Miller, Fenton, MI (US); Igor Anilovich, Walled Lake, MI (US); John W. Siekkinen, Novi, MI (US); Steven J. Shepherd, Commerce, MI (US); Robert S. Wickman, Westland, MI (US); Roberto De Paula, New Hudson, MI (US)

(73) Assignee: GM Global Technology Operations, Inc.

( * ) Notice: Subject to any disclaimer, the term of this patent is extended or adjusted under 35 U.S.C. 154(b) by 14 days.

(21) Appl. No.: 12/244,031

(22) Filed: Oct. 2, 2008

(65) Prior Publication Data

US 2010/0058848 A1 Mar. 11, 2010

Related U.S. Application Data

(60) Provisional application No. 61/095,987, filed on Sep. 11, 2008.

(51) Int. Cl.
*G01K 13/00* (2006.01)

(52) U.S. Cl. ..... 73/114.68; 374/145

(58) Field of Classification Search ..... 73/114.68; 374/145

See application file for complete search history.

(56) References Cited

U.S. PATENT DOCUMENTS

| | | | | |
|---|---|---|---|---|
| 4,580,531 | A * | 4/1986 | N'Guyen | 123/41.1 |
| 5,267,542 | A * | 12/1993 | Keskula | 123/406.65 |
| 6,302,065 | B1 * | 10/2001 | Davison | 123/41.15 |
| 7,168,399 | B2 * | 1/2007 | Wakahara | 123/41.15 |
| 7,325,447 | B2 * | 2/2008 | Miyahara et al. | 73/114.68 |
| 7,409,928 | B2 * | 8/2008 | Rizoulis et al. | 123/41.01 |
| 2007/0034172 | A1 * | 2/2007 | Miyahara et al. | 123/41.1 |
| 2007/0175415 | A1 * | 8/2007 | Rizoulis et al. | 123/41.05 |
| 2008/0300774 | A1 * | 12/2008 | Wakahara | 701/113 |
| 2009/0118090 | A1 * | 5/2009 | Heap et al. | 477/98 |
| 2009/0293600 | A1 * | 12/2009 | Coppola et al. | 73/114.68 |

* cited by examiner

*Primary Examiner* — Freddie Kirkland, III

(57) ABSTRACT

An engine coolant temperature estimation system comprises a coolant temperature estimation module and a coolant monitoring module. The coolant estimation module estimates an engine coolant temperature based on at least one of a mass air flow, a vehicle speed, and an ambient temperature. The coolant monitoring module selectively operates an engine based on the estimated engine coolant temperature.

13 Claims, 6 Drawing Sheets

ENGINE COOLANT TEMPERATURE ESTIMATION SYSTEM

CROSS-REFERENCE TO RELATED APPLICATIONS

This application claims the benefit of U.S. Provisional Application No. 61/095,987, filed on Sep. 11, 2008. The disclosure of the above application is incorporated herein by reference.

FIELD

The present disclosure relates to an engine coolant temperature estimation system for an engine.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Coolant temperature is typically determined by a sensor in fluid communication with the coolant of a vehicle. When the engine coolant temperature sensor is faulty, a default coolant temperature may be used instead of the measured temperature. For example, the vehicle may use an engine coolant temperature estimate. Because the coolant temperature can be a significant factor in vehicle performance, an accurate coolant temperature estimate is desirable.

SUMMARY

An engine coolant temperature estimation system includes a coolant temperature estimation module and a coolant monitoring module. The coolant estimation module estimates an engine coolant temperature based on at least one of a mass air flow, a vehicle speed, and an ambient temperature. The coolant monitoring module selectively operates an engine based on the estimated engine coolant temperature.

A engine coolant temperature estimation method includes estimating an engine coolant temperature based on at least one of a mass air flow, a vehicle speed, and an ambient temperature. The method includes selectively operating an engine based on the estimated engine coolant temperature.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
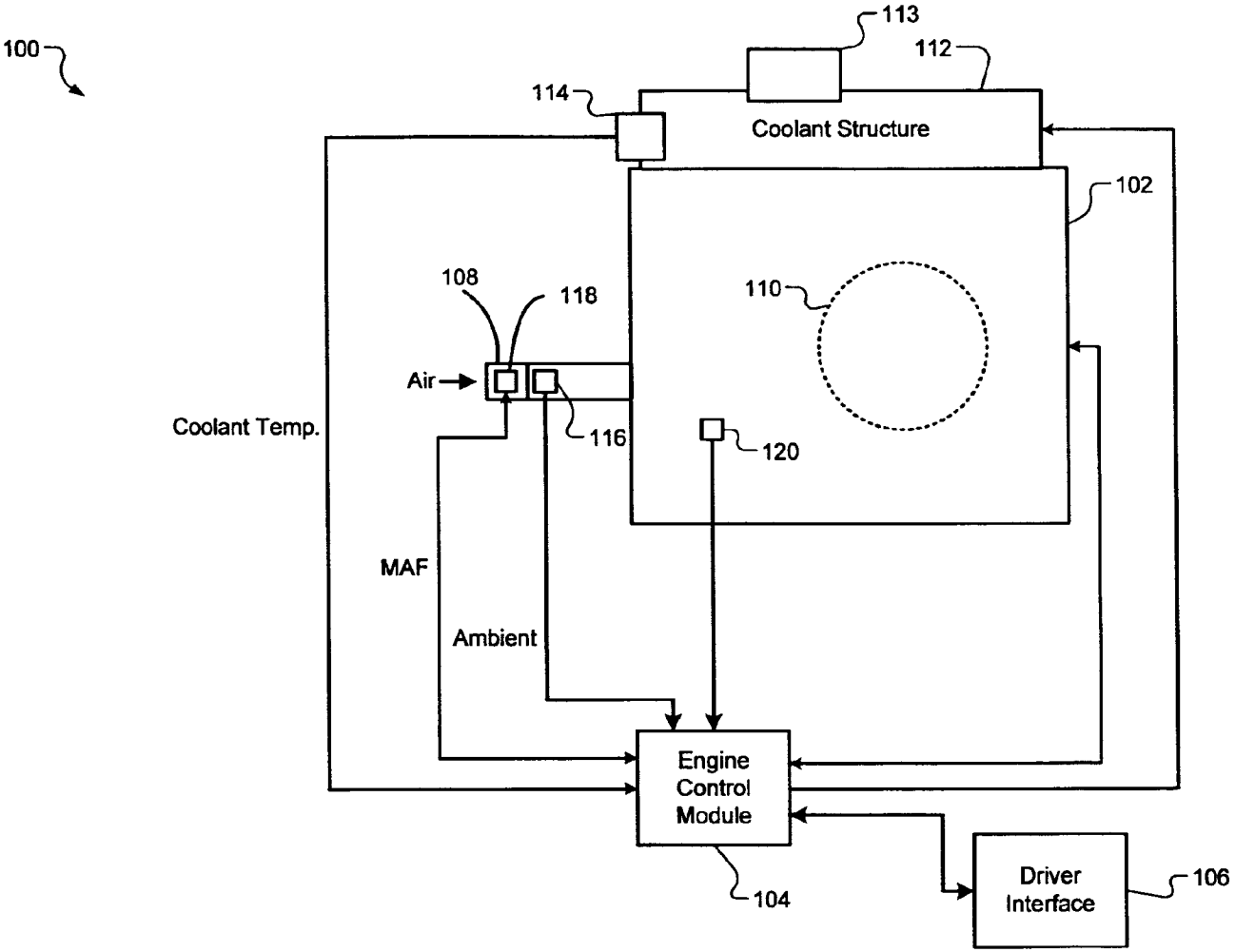
FIG. 1 is a functional block diagram of a vehicle implementing an engine coolant temperature estimation system according to the present disclosure.

The following description is merely exemplary in nature and is not intended to limit the present disclosure, application, or uses. It should be understood that throughout the drawings, corresponding reference numerals indicate like or corresponding parts and features. As used herein, the term module refers to an application specific integrated circuit (ASIC), an electronic circuit, a processor (shared, dedicated, or group) and memory that execute one or more software or firmware programs, a combinational logic circuit, or other suitable components that provide the described functionality.

Figure 2:
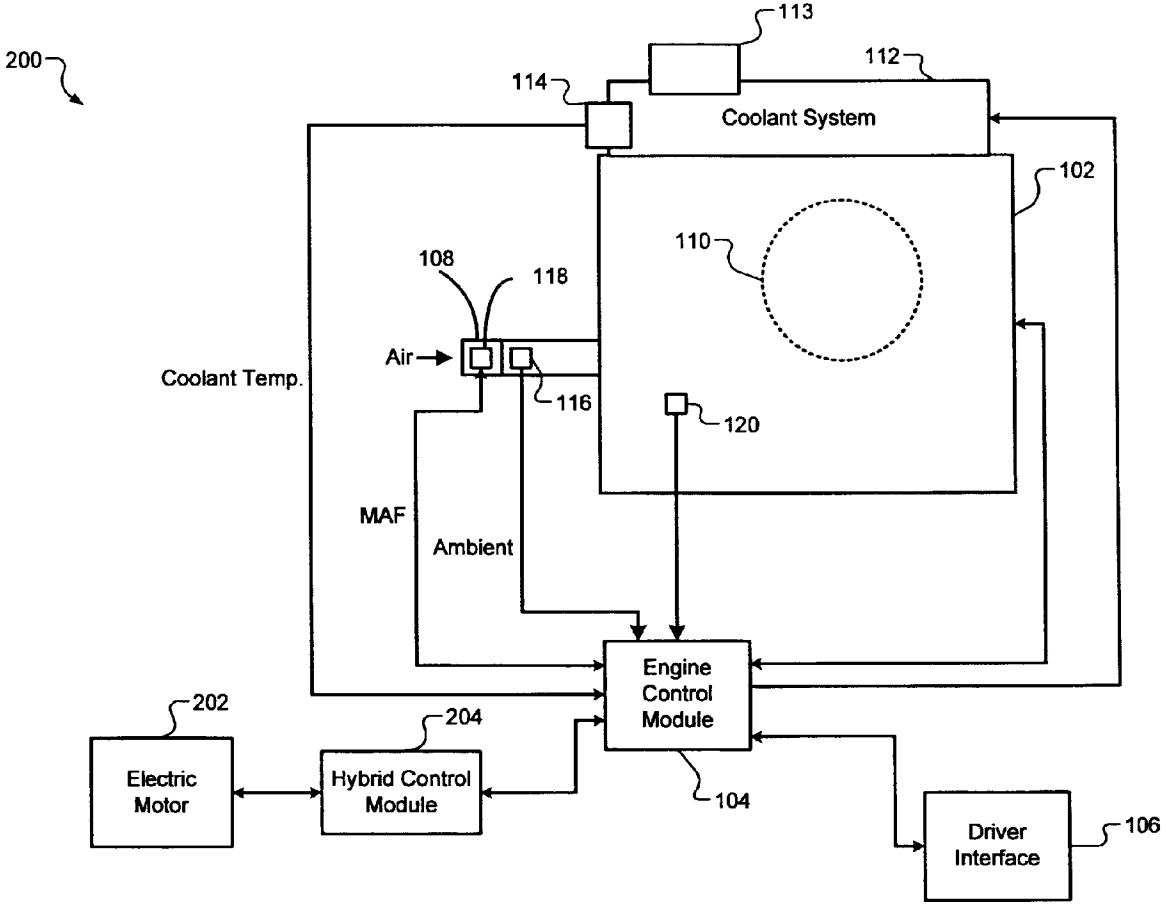
FIG. 2 is a functional block diagram of a hybrid vehicle using multiple power sources implementing an engine coolant temperature estimation system according to the present disclosure.

Referring now to FIGS. 1 and 2, a vehicle 100 includes an engine 102 and an engine control module 104, which controls various components and functions of the engine 102. The engine control module 104 may perform a plurality of operations including, but not limited to, engine control and diagnostics. For example, the engine control module 104 receives signals from various sensors and adjusts operation of various engine components based on the signals. The engine control module 104 also sends information to the driver through a driver interface 106. For example, the driver interface 106 may report information to the driver regarding the essential operations of the vehicle 100. The driver interface 106 may display indicator lights when a vehicle component is not operating properly.

The vehicle 100 includes an air intake 108. Air flows through the air intake 108 and is combusted with fuel in a cylinder 110 to propel the vehicle 100. A portion of heat energy generated during combustion is absorbed by engine components. The engine 102 includes a coolant system 112 to remove excess heat. For example, the coolant system 112 includes a coolant liquid. The coolant temperature is regulated by a thermostat 113 to remove excess heat and prevent damage to engine components.

The engine control module 104 receives temperature readings from a coolant temperature sensor 114. Further, the engine control module 1042 estimates the coolant temperature for various engine states and ambient temperatures in the event of a failure in the coolant temperature sensor 114. For example, the engine control module 104 estimates the engine coolant temperature based on measurements received from various other sensors, including, but not limited to, an ambient temperature sensor 116, a mass airflow sensor 118, and a vehicle speed sensor 120.

Referring now to FIG. 2, a hybrid vehicle 200 includes the internal combustion engine 102, an electric motor 202, and a hybrid control module 204. The engine control module 104, according to the present disclosure, may be included in an internal combustion engine system or a hybrid propulsion system. Although the vehicle 200 is shown with the electric motor 202, the vehicle 200 may include any form of hybrid propulsion, for example, fuel cells or ethanol engines.

Figure 3:
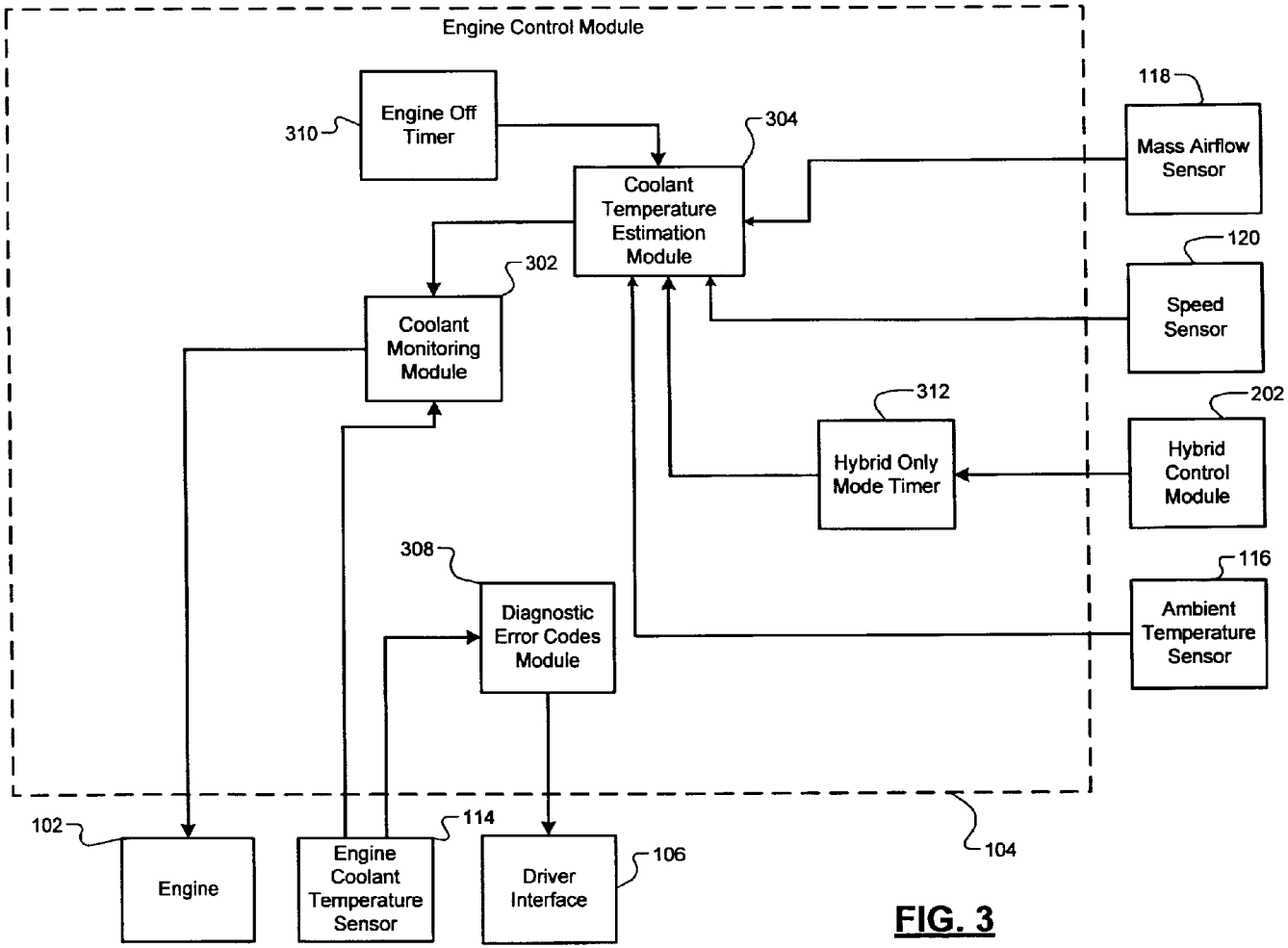
FIG. 3 is a functional block diagram of an engine control module that includes the engine coolant temperature estimation system according to the present disclosure.

Referring now to FIG. 3, the engine control module 104 includes a coolant monitoring module 302. The coolant monitoring module 302 communicates with the engine coolant temperature sensor 114 to determine whether the engine coolant is within an operable range of temperatures. For example, the coolant monitoring module 302 receives a temperature signal from the engine coolant temperature sensor 114. The coolant monitoring module 302 determines whether the temperature signal is within a predetermined temperature range. The engine control module 104 may selectively operate the engine 102 based on whether the temperature is within the predetermined temperature range.

The coolant monitoring module 302 further operates based on an engine coolant temperature estimated by a coolant temperature estimation module 304. For example, a diagnostic error code module 308 may determine that the engine coolant temperature sensor 114 is faulty and report the fault through the driver interface 106. The engine control module 104 uses the estimated temperature from the coolant temperature estimation module 304, thereby allowing the engine to start without a functioning engine coolant temperature sensor.

The coolant temperature estimation module 304 receives inputs from the mass airflow sensor 118, the vehicle speed sensor 120, the ambient temperature sensor 116, an engine off timer 310, and estimates the coolant temperature accordingly. If the vehicle includes a hybrid drivetrain, the coolant temperature estimation module 304 may also receive a hybrid only time from a hybrid only mode timer 312. The hybrid only timer indicates a time period that the vehicle 100 has been propelled only by the electric motor 202. The coolant temperature estimation module 304 estimates the coolant temperature and transmits the results of the estimation to the coolant monitoring module 302.

Figure 4:
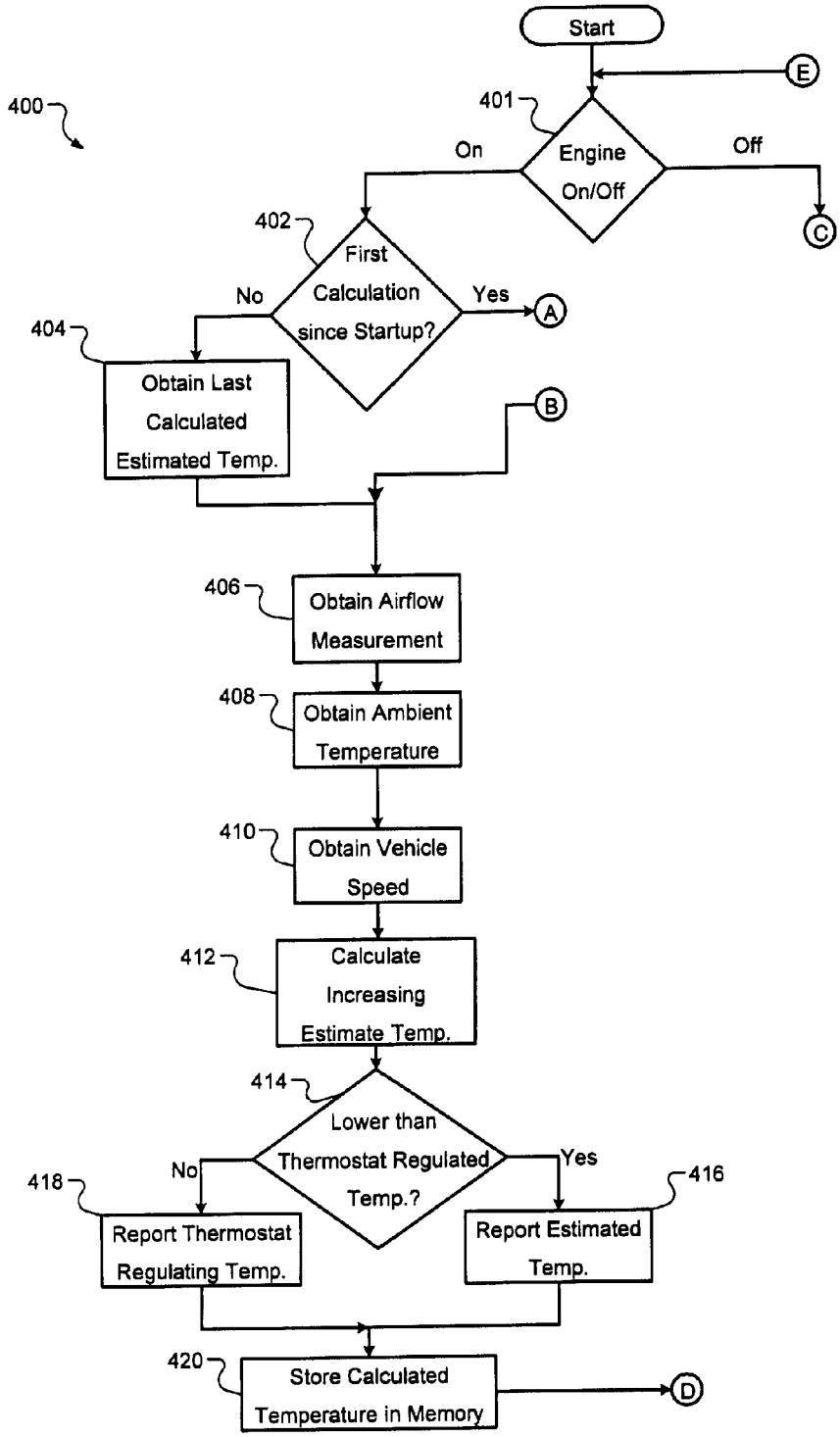
FIG. 4 is a first flow chart illustrating steps of an engine coolant temperature estimation method when the engine is on according to the present disclosure.
Figure 5:
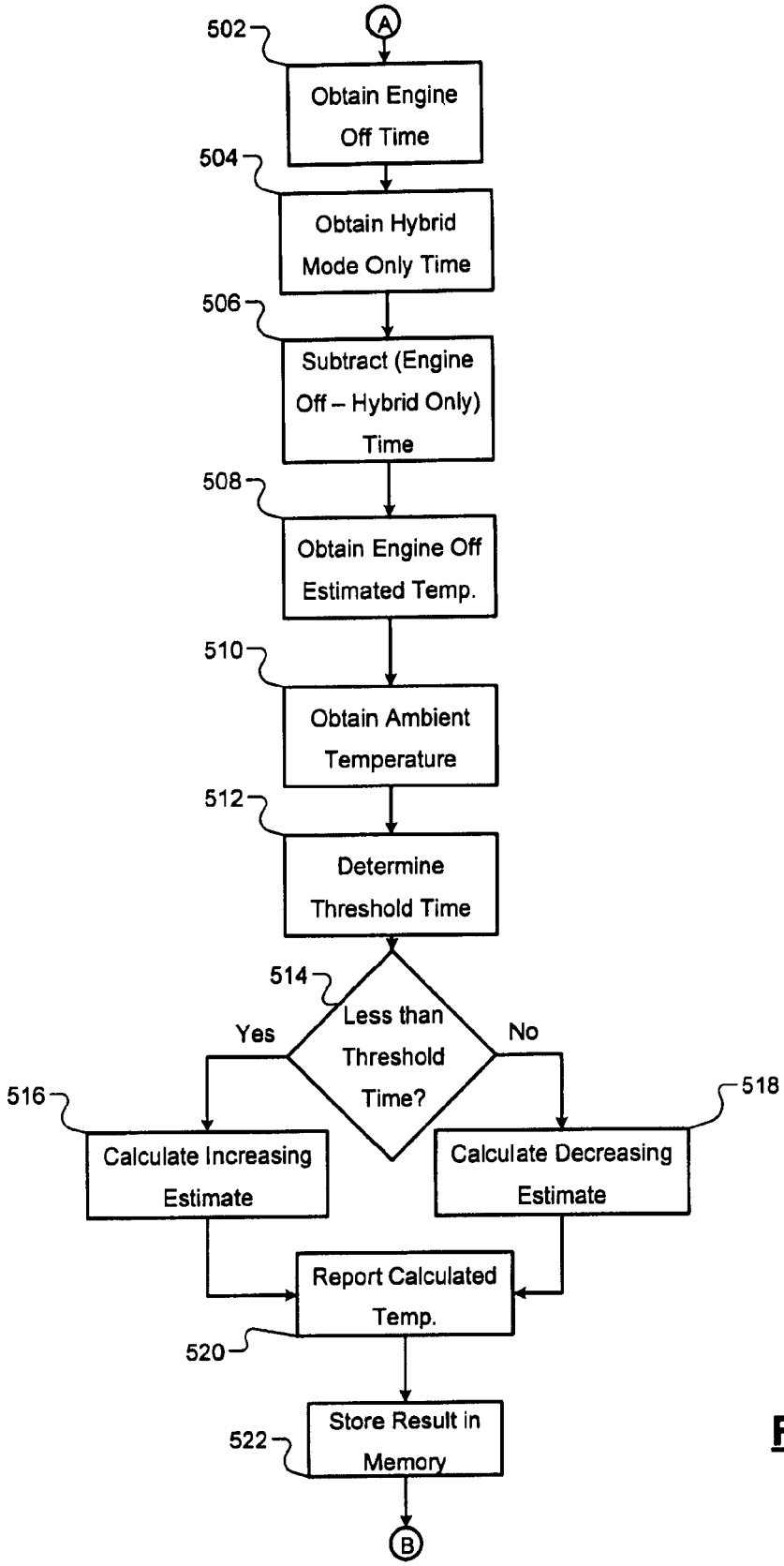
FIG. 5 is a second flow chart illustrating steps of the engine coolant temperature estimation method according to the present disclosure.
Figure 6:
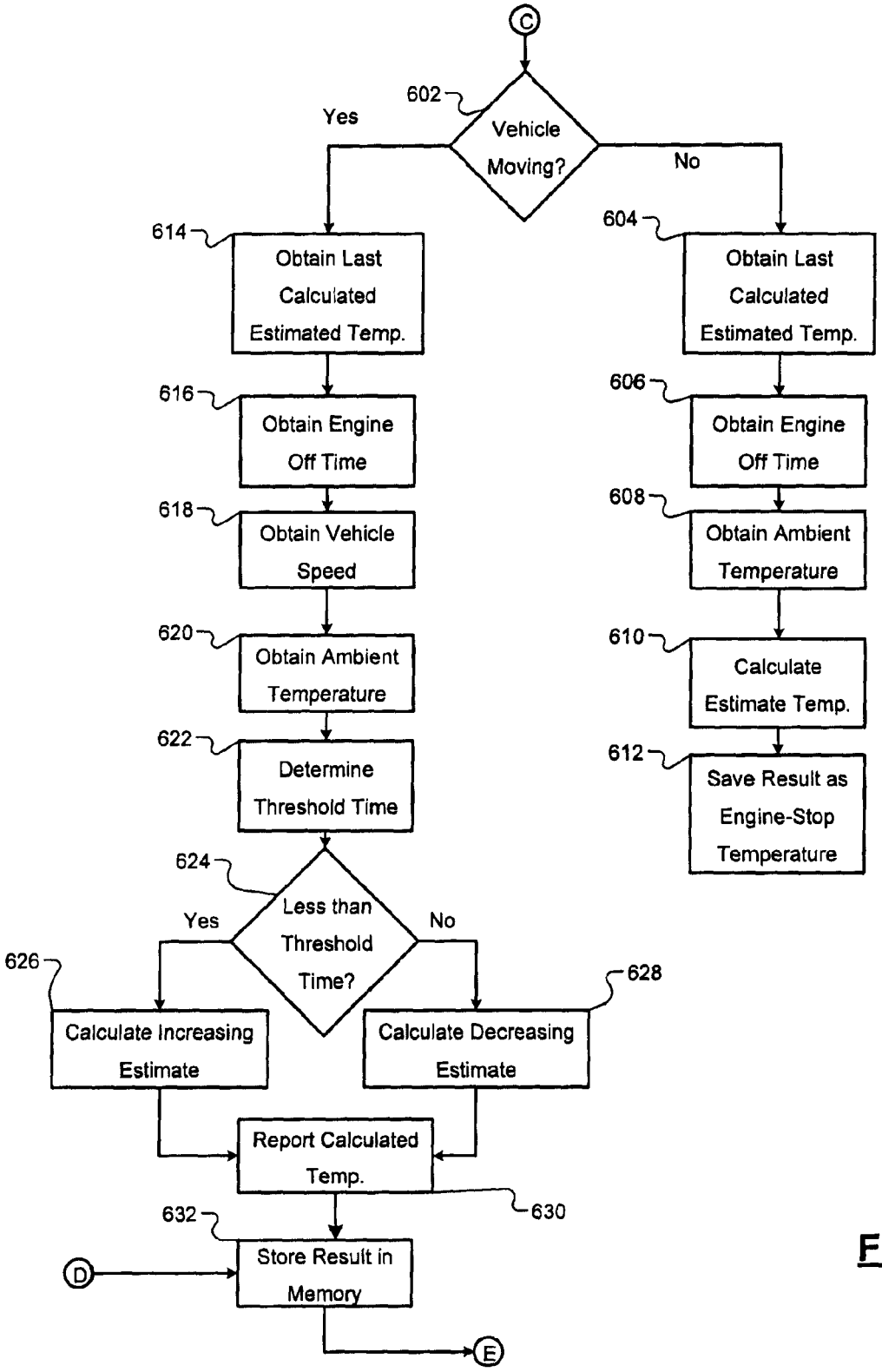
FIG. 6 is a third flow chart illustrating the steps of an engine coolant temperature estimation method when the engine is off according to the present disclosure.

Referring now to FIGS. 4-6, an engine coolant estimation method 400 is shown. In step 401, the engine coolant estimation method 400 determines whether the internal combustion engine 102 is on or off.

In step 402, the method 400 determines whether the current iteration of the method 400 is the first iteration since the engine 102 was powered on. If false, the method 400 obtains a previous estimated temperature from memory in step 404.

Coolant temperature relates to a load on the engine. Accordingly, the method 400 uses the mass airflow measurement from the mass airflow sensor 118 to estimate the engine coolant temperature. The coolant estimation system obtains the mass air flow reading from the mass airflow sensor 118 in step 406. In steps 408 and 410, the engine coolant estimation system obtains measurements of the ambient temperature and vehicle speed. For example, vehicle speed and ambient temperature may indicate the increased convection on the engine. Similarly, in step 412, the method 400 estimates the engine coolant temperature according to the mass airflow, the ambient temperature, and vehicle speed.

Because the engine coolant temperature is regulated by the thermostat 113, the engine coolant estimation module 306 reports the thermostat regulated temperature whenever the estimated temperature reaches the thermostat regulated temperature value. In step 414, the method 400 determines whether the estimated engine coolant temperature is lower than the thermostat regulated temperature. If true, the method 400 reports the estimated temperature to the coolant monitoring module 302 in step 416. If false, the method 400 reports the thermostat regulating temperature in step 418.

In step 420, the method 400 stores the estimated temperature to memory and reports the estimated engine coolant temperature to the coolant monitoring module 302.

Referring to FIG. 5., the method 400 estimate uses the estimated coolant temperature from the previous iteration. As described in FIG. 4, the coolant estimation system determines whether the current iteration is the first iteration in step 402. If true, the method 400 determines the change in engine coolant temperature since the vehicle last stopped moving.

In step 502, the method 400 obtains the amount time that the internal combustion engine 102 has been off. In step 504, the method 400 determines the time the vehicle 100 was driven in hybrid only mode, if the vehicle 100 is a hybrid drivetrain. In step 506, the engine coolant temperature estimation method 400 subtracts the hybrid only time from the engine off time.

In steps 508 and 510, the method 400 obtains the ambient temperature from the ambient temperature sensor 116 and the estimated coolant temperature saved in memory.

The engine coolant temperature estimation method 400 estimates the coolant temperature when the engine is first turned back on. The method 400 models the behavior of the engine coolant temperature while the engine was off. For example, the engine coolant temperature may initially increase before a threshold time and decrease after the threshold time. Based on the ambient temperature, the method 400 determines the threshold time in step 514. Before the threshold time, the temperature of the coolant increases towards a shut off engine temperature. After the threshold time, the engine coolant temperature decreases toward the ambient temperature. Both the increasing in engine coolant temperature before the threshold time and the decreasing in engine coolant temperature after the threshold time may be exponential. The amount of increase in engine coolant temperature may depend on the engine shut off temperature. For example, the higher the engine shut off temperature, the greater the increase in the engine coolant temperature. Similarly, the decrease in the engine coolant temperature may correspond to the ambient temperature. The method 400 uses the above described behavior to estimate the engine coolant temperature at engine start up.

In step 516 or 518, the method 400 estimates the current engine coolant temperature as a result of the engine off time. If the amount of time the since vehicle 100 stopped moving and the engine 102 is turned off is less than the threshold time, the method 400 estimates the increase in temperature in step 516. If the amount of time since the vehicle 100 stopped moving and the engine 102 is turned off is more than the threshold time, the method 400 then estimates the engine coolant temperature as a result of the decrease in temperature in step 518. In step 520, the system reports the estimated temperature to the coolant monitoring module 302. In step 522, the system stores the result of the estimation in memory.

Referring now to FIG. 6, if the engine 102 is not powered on as determined in step 401, the method 400 determines whether the vehicle 100 is moving in step 602. The method 400 obtains the previously stored estimated coolant temperature value from memory, the engine off time, and the ambient temperature in steps 604, 606, 608, respectively. The method 400 estimates the engine coolant temperature in step 610. In step 612, the method 400 stores that value in memory as the engine-stop estimated coolant temperature. The method 400 uses the stored engine stop estimated coolant temperature the next time the engine 102 is started to estimate the change in temperature while the engine 102 was off.

When the vehicle 100 is moving, but being propelled by an alternative driving force, the engine has increased convection, and therefore decreases the engine coolant temperature faster than if the vehicle 100 is stopped. The method 400 accounts for hybrid drivetrain and estimates the engine coolant temperature, for example only, within 5-10 degrees Fahrenheit.

The method 400 obtains the previously stored engine coolant temperature estimate from memory, the engine off time, the vehicle speed, and the ambient temperatures in steps 614, 616, 618, 620, respectively. The method 400 uses the ambient temperature to generate a threshold time in step 622. In step 624, the method 400 compares the threshold time to the engine off time and estimates either an increase in temperature, in step 626, or a decrease in temperature in step 628. In step 630, the method 400 reports the estimated temperature to the coolant monitoring module 302 and the method 400 stores the value to memory in step 632.

Those skilled in the art can now appreciate from the foregoing description that the broad teachings of the current disclosure can be implemented in a variety of forms. Therefore, while this disclosure has been described in connection with particular examples thereof, the true scope of the invention should not be so limited since other modifications will become apparent to the skilled practitioner upon a study of the drawings, the specification and the following claims.

What is claimed is:

1. An engine coolant temperature estimation system for a vehicle, comprising:

a coolant temperature estimation module that estimates an engine coolant temperature i) based on mass air flow, vehicle speed, and ambient temperature when an engine is on, and ii) based on vehicle speed, ambient temperature, and engine off time when the engine is off and the vehicle is moving; and a coolant monitoring module that selectively operates the engine based on the estimated engine coolant temperature.

2. The engine coolant temperature estimation system of claim 1 wherein the estimated engine coolant temperature is further based on a thermostat regulating temperature when the engine is on.

3. The engine coolant temperature estimation system of claim 1 wherein the coolant temperature module estimates at least one of an increase and a decrease in the estimated engine coolant temperature based on the engine off time.

4. The engine coolant temperature estimation system of claim 1 wherein the coolant monitoring module operates the engine based on an engine coolant temperature sensor measurement and the estimated engine coolant temperature.

5. The engine coolant temperature estimation system of claim 4 wherein the coolant monitoring module shuts off the engine when the coolant temperature exceeds a threshold.

6. The engine coolant temperature estimation system of claim 1 further comprising a timing module that determines the engine off time.

7. The engine coolant temperature estimation system of claim 1 further comprising a timing module that reports an amount of time the vehicle has been powered by a hybrid motor only, wherein the engine coolant temperature estimate is further based the amount of time the vehicle is powered by only the hybrid motor from the timing module.

8. An engine coolant temperature estimation method for a vehicle, comprising:

estimating an engine coolant temperature based on a mass air flow, a vehicle speed, and an ambient temperature;

estimating an engine coolant temperature based on mass air flow, vehicle speed, and ambient temperature when an engine is on; estimating the engine coolant temperature based on engine off time, vehicle speed, and ambient temperature when the engine is off and the vehicle is moving; and selectively operating the engine based on the estimated engine coolant temperature.

9. The method of claim 8 further comprising estimating the engine coolant temperature further based on a thermostat regulating temperature when the engine is on.

10. The engine method of claim 8 further comprising estimating at least one of an increase and a decrease in the estimated engine coolant temperature based on the engine off time.

11. The method of claim 8 further comprising operating the engine based on an engine coolant temperature sensor measurement and the estimated engine coolant temperature.

12. The method of claim 11 further comprising shutting off the engine when the coolant temperature exceeds a threshold.

13. The method of claim 8 further comprising determining an amount of time that the vehicle is powered by a hybrid motor only, wherein the engine coolant temperature estimate is further based the amount of time the vehicle is powered by only the hybrid motor from the timing module.

* * * * *